US009011100B2

(12) United States Patent
Ulgen

(10) Patent No.: US 9,011,100 B2
(45) Date of Patent: Apr. 21, 2015

(54) DEMOUNTABLE PROPELLER

(76) Inventor: Mehmet Nevres Ulgen, Istanbul (TR)

( * ) Notice: Subject to any disclaimer, the term of this patent is extended or adjusted under 35 U.S.C. 154(b) by 476 days.

(21) Appl. No.: 13/611,879

(22) Filed: Sep. 12, 2012

(65) Prior Publication Data

US 2014/0072445 A1 Mar. 13, 2014

(51) Int. Cl.

| | |
|---|---|
| ***B63H 1/20*** | (2006.01) |
| ***F04D 29/38*** | (2006.01) |
| ***F04D 29/32*** | (2006.01) |

(52) U.S. Cl.

CPC ..... *B63H 1/20* (2013.01); *F04D 29/388* (2013.01); *F04D 29/322* (2013.01); *F04D 29/329* (2013.01)

(58) Field of Classification Search

CPC ... F04D 29/329; F04D 29/332; F04D 29/388; B63H 1/20

USPC ..... 416/208, 200 R, 212 R

See application file for complete search history.

(56) References Cited

U.S. PATENT DOCUMENTS

| | | | | |
|---|---|---|---|---|
| 1,017,820 | A * | 2/1912 | Svebilius | 416/200 R |
| 1,122,925 | A | 12/1914 | Henrichsen | |
| 3,764,228 | A | 10/1973 | Shook | |
| 3,791,762 | A * | 2/1974 | Brehme | 416/198 R |
| 4,960,987 | A | 10/1990 | Frank | |
| 5,611,668 | A * | 3/1997 | Yapp et al. | 416/189 |
| 6,537,031 | B1 | 3/2003 | Bacskay | |
| 7,083,386 | B2 * | 8/2006 | Horng et al. | 416/175 |

FOREIGN PATENT DOCUMENTS

| | | |
|---|---|---|
| CN | 2248162 Y | 2/1997 |
| GB | 2264983 A | 9/1993 |
| GB | 2328251 A | 2/1999 |
| JP | 1237068 | 9/1989 |

* cited by examiner

*Primary Examiner* — Ninh H Nguyen

(74) *Attorney, Agent, or Firm* — Vidas, Arrett & Steinkraus, P.A.

(57) ABSTRACT

A marine vessel propeller comprising an even number of blades such as 4, 6, 8, which can be mounted or demounted to a hub made of two parts each having the half of the blades. The blades can be rigidly connected to each other by means of connecting members.

10 Claims, 5 Drawing Sheets

DEMOUNTABLE PROPELLER

CROSS-REFERENCE TO RELATED APPLICATIONS

Not applicable.

STATEMENT REGARDING FEDERALLY SPONSORED RESEARCH

Not applicable.

BACKGROUND OF THE INVENTION

The present invention relates to a marine vessel propeller comprising an even number of blades such as 4, 6, 8, which can be mounted or demounted to a hub made of two parts each having the half of the blades. The blades can be rigidly connected to each other by means of connecting members.

Propulsion required for the movement of marine vessels sailing afloat such as boats, ships and under water such as submarines is provided by propellers. Propellers, in general, consist of a central hub and plurality of blades combined with the hub. The surfaces of the propeller blades are generally helicoidal and the flowing water is caught by the leading edge of the blade and compressed on the helicoidal surface to form a pressure and then it accelerates over the blade and leaves from the trailing edge. The course of the fluid on blade surface, and hence the water compression on blade surface affect the amount of thrust to be obtained.

Propellers are conventionally cast in one piece and produced after being machined. In other words, the blades are integrally produced with the hub. This structure has some disadvantages: For example, blades, in general, are not allowed to overlap for the removal of the propellers from the cast mold, and for the surface machining after molding; and therefore such blades can get slightly higher than surface area ratio 1:1, generally being under value of 1 (e.g. 0.950). Another disadvantage of the known propellers is that in case one of the blades is damaged due to mechanical fatigue, external impacts, or some other reasons, the entire propeller needs to be replaced. Moreover, in order to obtain a maximum thrust from the blades which are radially aligned around the hub, the blades need to be provided all through the hub thickness (in other words in the direction of hub depth). Manufacturing cost of such a structure of a complicated geometry increases, because it requires a detailed planning during and before the operation; huge counter and machine tracks are needed so as to cover the size of whole propeller.

In order to overcome the abovementioned drawbacks, propellers having demountable blades have been introduced. Such propellers are known to have some certain disadvantages such as having non-uniformly shaped blades. For example, each blade is likely to have different mass from one another when they are produced by casting which is widely-used in blade production. This would inevitably lead to a decrease in thrust performance of the propeller. In fact, the material discontinuity that may occur inside the blade material during casting of the blade or the fact that the blade form cannot be always obtained in its same perfectness cause a balance problem in the propeller. On the other hand, the connection of each blade to the hub may not be of the desired rigidity. For example, the blade-hub connection loses its rigidity because of the vibrations emerging in time, and therefore the blade-to-hub connection weakens and the propeller balance is negatively affected, as a result of which the thrust performance decreases.

BRIEF SUMMARY OF THE INVENTION

An object of the present invention is to provide a propeller which has an increased performance and which can be produced relatively easily.

In accordance with this object, the present invention relates to a propeller comprising a cylindrical hub rotatable about an axis and a plurality of blades provided radially around the hub, wherein the hub is made up of a first part and a second part mounted to the first part in the axial direction, wherein the first part comprises a plurality of housings each having a relatively short space and a relatively long space, the housings provided circularly around the rotation axis; the second part comprises a plurality of protrusions each having a relatively short extension and a relatively long extension, the protrusions provided circularly around the rotation axis, and wherein the first part is rigidly mounted to the second part by a plurality of connecting members.

According to a preferred embodiment of the present invention, each hub part is integrally produced with its blades. The housings of the first hub part extend from the surface where the first hub part is mounted to the second hub part in a way that they are located around the axis of the first hub part in an axial manner. Likewise, the protrusions of the second hub part extend from the surface where the second hub part is mounted to the first hub part in a way that they are located around the axis of the second hub part in an axial manner. When the hub parts are combined with each other, the relatively long and relatively short extensions of each protrusion are fitted into the relatively long and relatively short spaces of each housing respectively. The relatively short and relatively long spaces forming each housing, and likewise the relatively short and relatively long extensions forming each protrusion are collaterally located. Therefore, while the first hub and the second hub are being combined, it is possible to fix one hub by rotating it slightly with respect to the other. Otherwise, it is not possible to fix one hub part without rotating it slightly with respect to the other one, as the blades will clash.

Therefore, it becomes possible to produce propellers having bigger surface area ratio.

The connection of the hub parts with each other is provided by means of preferably bolts and nuts. Therefore holes are provided around the rotation axis of the hub parts, all through the hub thickness.

BRIEF DESCRIPTION OF THE SEVERAL VIEWS OF THE DRAWINGS

In order for the present invention to be understood best with its main structure and the additional elements, it should be evaluated together with the figures described below.

DETAILED DESCRIPTION OF THE INVENTION

Figure 1:
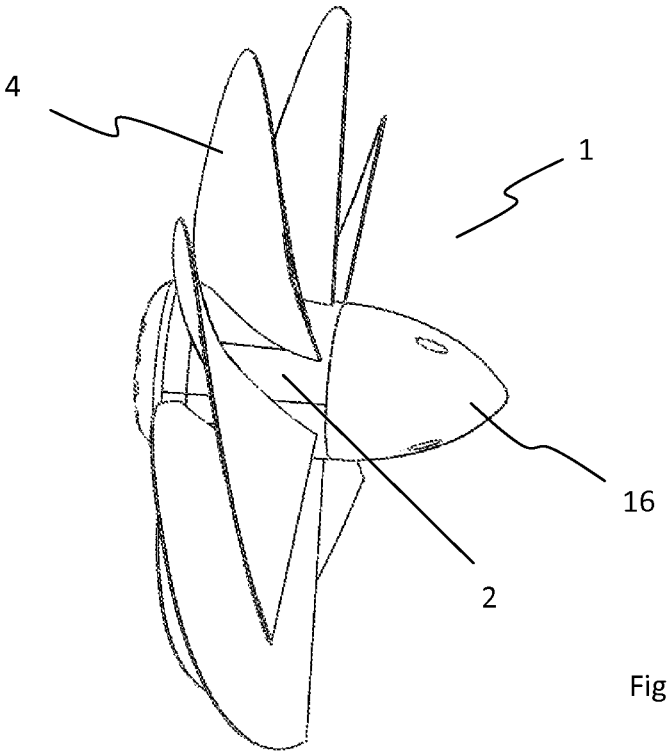
FIG. 1 shows the perspective view of the propeller according to the present invention in mounted position.
Figure 2:
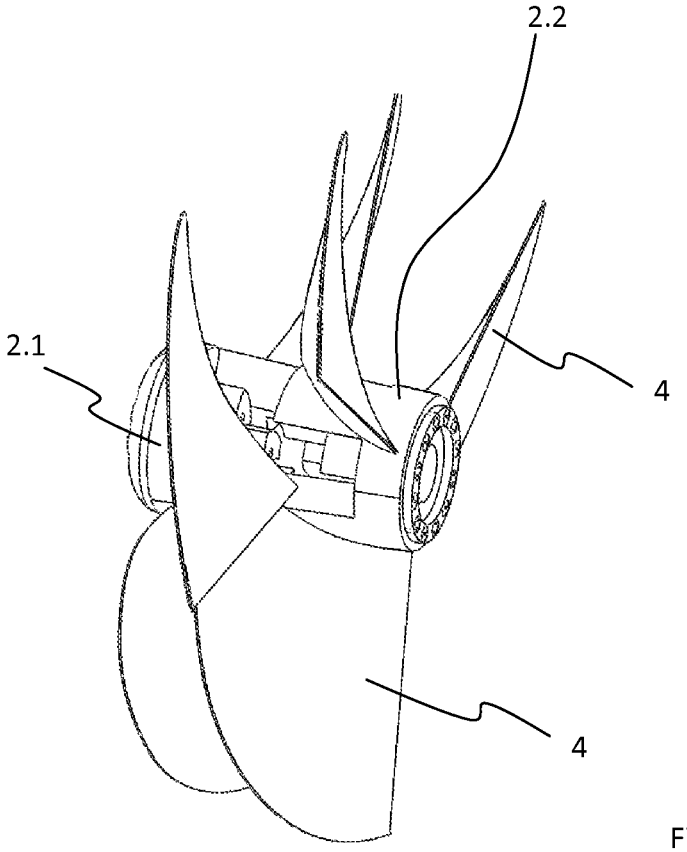
FIG. 2 shows the perspective view of the parts making up of the propeller hub before they are combined.
Figure 3:
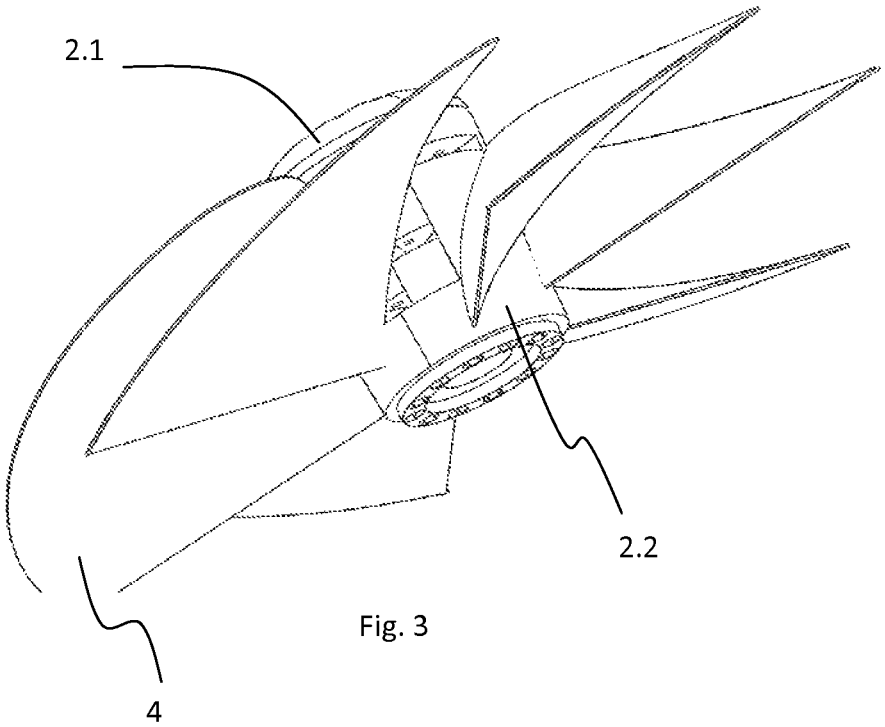
FIG. 3 shows the perspective view of the parts making up of the propeller hub before they are combined.
Figure 4:
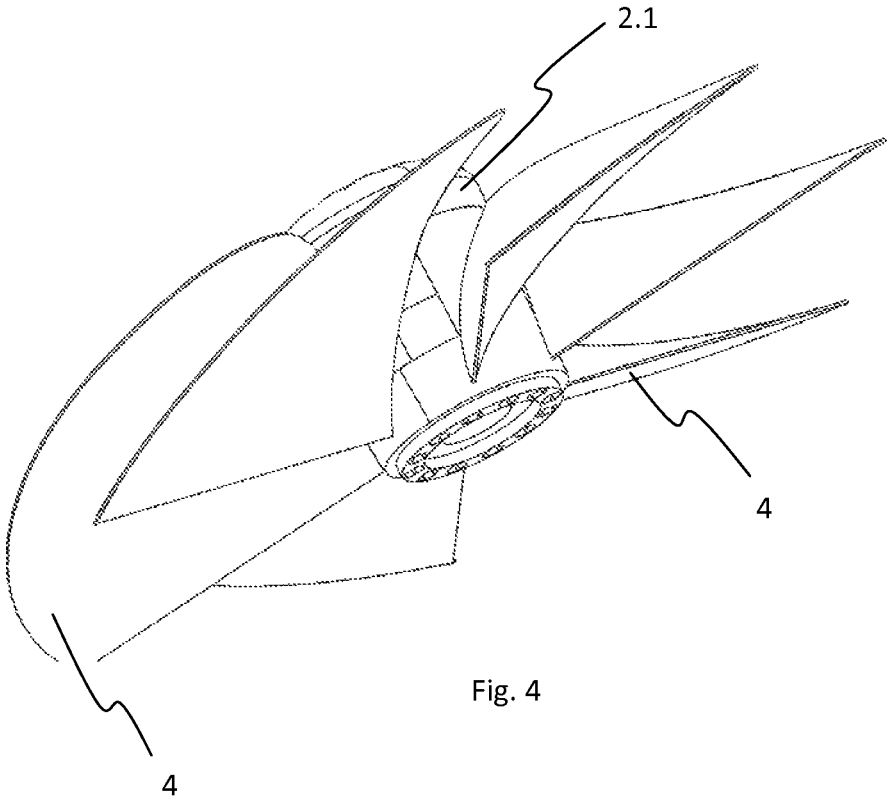
FIG. 4 shows the perspective view of the propeller parts when they get closer to each other according to position in FIG. 3.
Figure 5:
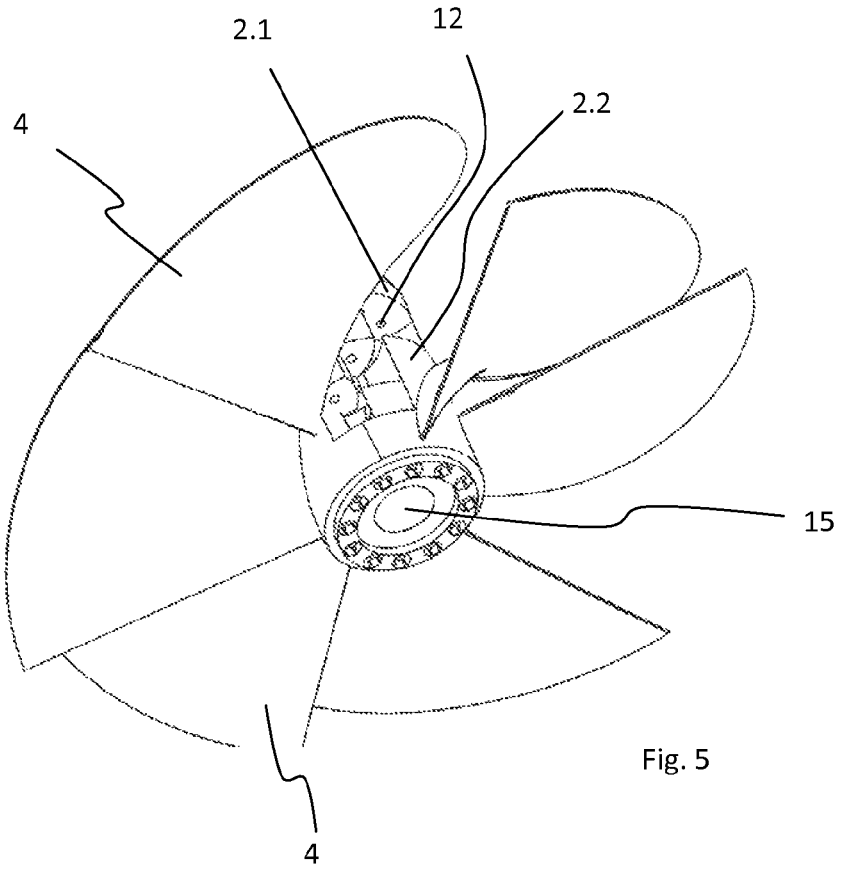
FIG. 5 shows another perspective view of the parts making up of the propeller hub before they are combined.
Figure 6:
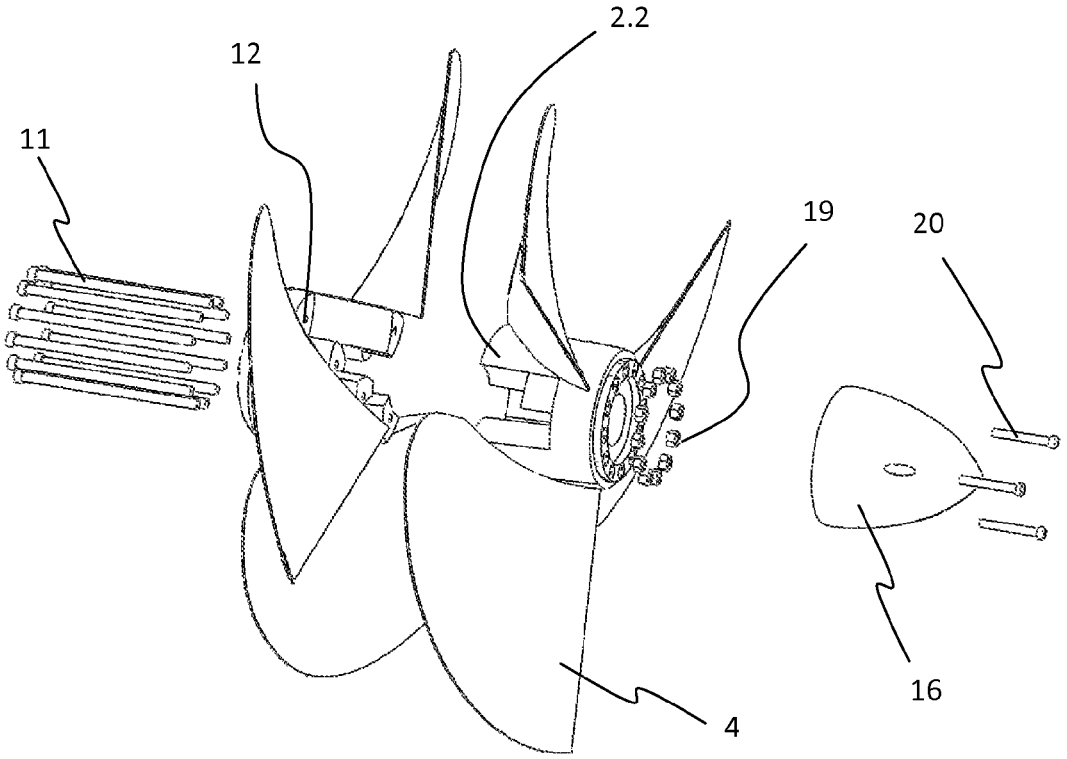
FIG. 6 shows an exploded perspective view of the parts making up of the propeller hub.
Figure 7:
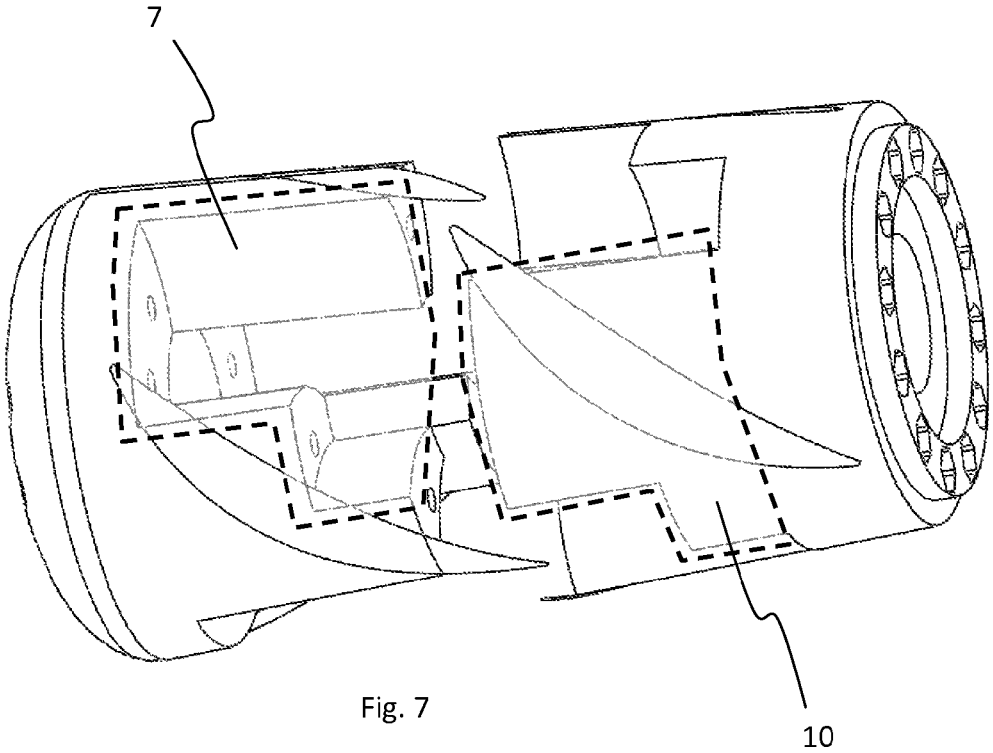
FIG. 7 shows a perspective view of the parts making up of the propeller hub before they are combined without the propeller blades.
Figure 8:
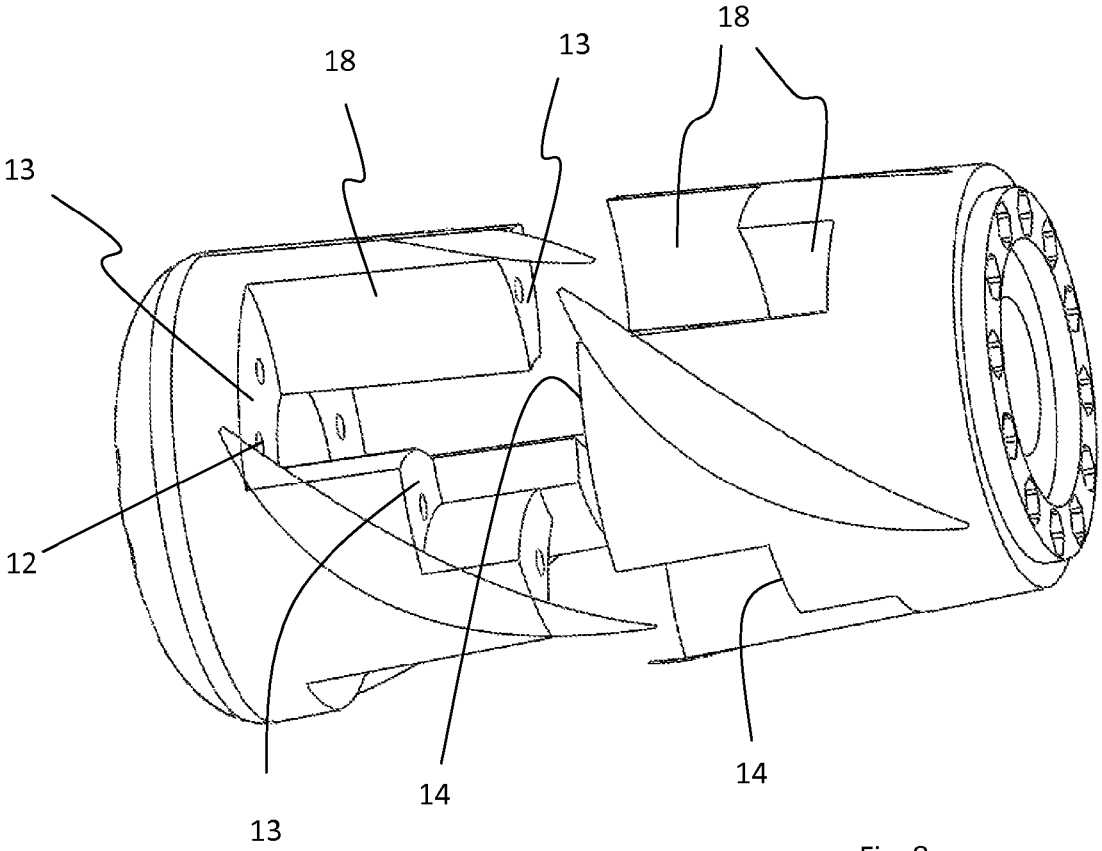
FIG. 8 shows a perspective view of the parts making up of the propeller hub before they are combined without the propeller blades.
Figure 9:
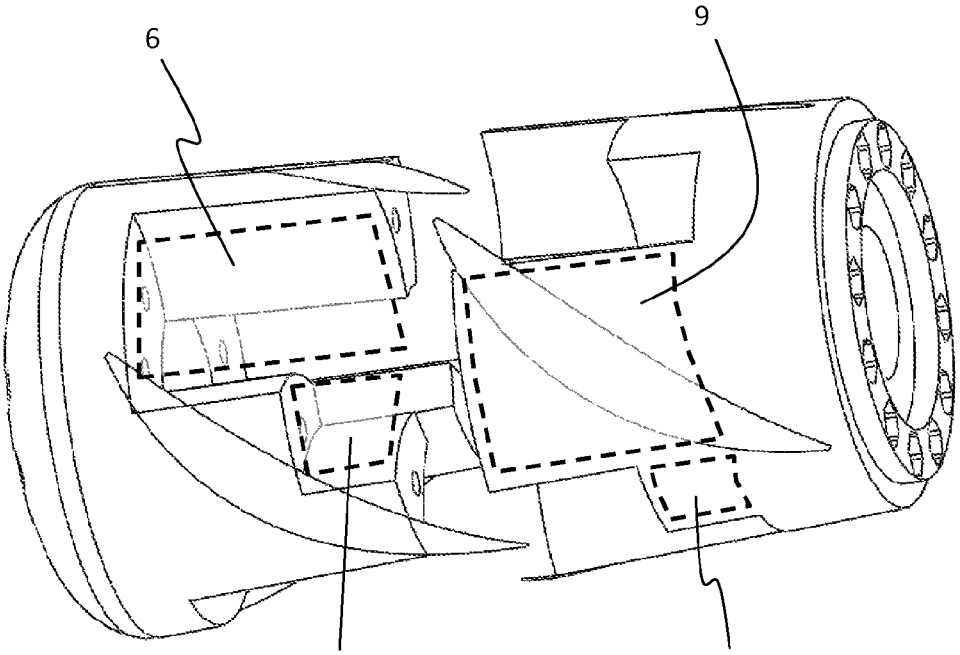
FIG. 9 shows a perspective view of the parts making up of the propeller hub before they are combined without the propeller blades.
Figure 10:
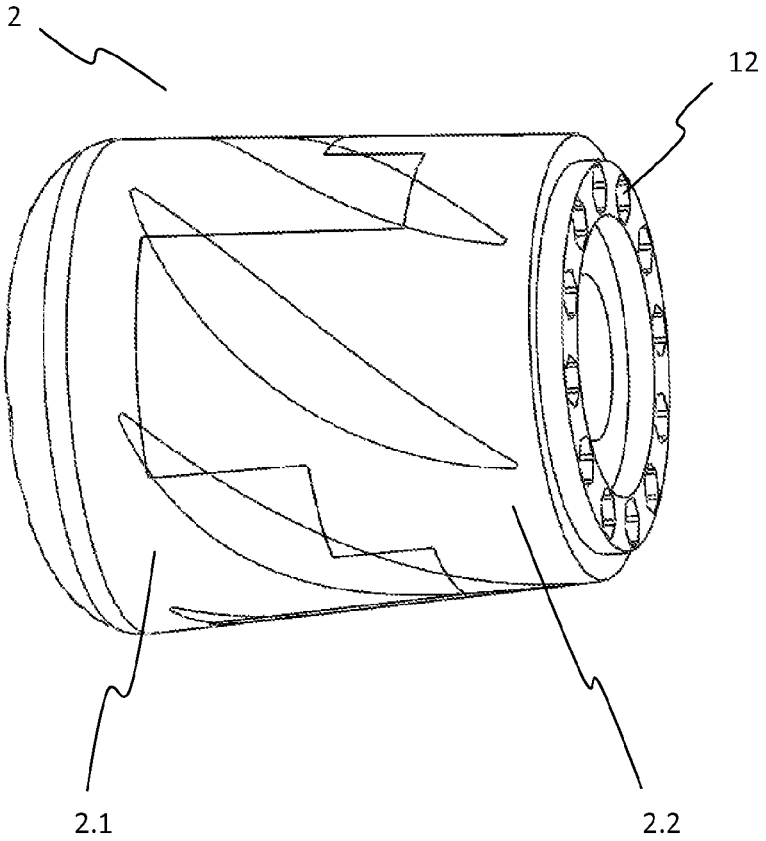
FIG. 10 shows a perspective view of the parts making up of the propeller hub after they are combined without the propeller blades.

While this invention may be embodied in many different forms, there are described in detail herein a specific preferred embodiment of the invention. This description is an exemplification of the principles of the invention and is not intended to limit the invention to the particular embodiment illustrated As it is shown in FIG. 1, the present invention comprises a propeller (1) to be used in moving a marine vessel in the sea, a hub (2) of cylindrical form rotatable about a rotation axis, and blades (4) which are arranged radially around the hub (2). There is provided a shaft-fitting opening (15) at the center of the hub (2). A shaft connected to the marine vessel motor from one end is inserted in the opening (15).

The hub (2) comprises a first hub part (2.1) and a second hub part (2.2) which can be connected to the first hub part (2.1). Each hub part (2.1, 2.2) comprises a plurality of blades (4) which are produced preferably in one-piece form with the respective hub part. When the hub parts (2.1, 2.2) are mounted to one another, the number of propeller blades reaches to an even number such as 4, 6, 8.

The hub parts (2.1, 2.2) are mounted to one another by getting axially one closer to another. However, as it will be described in detail in the following, one of the hub parts is rotated slightly with respect to the other during the mounting process. The first hub part (2.1) comprises a plurality of housings (7) comprising one relatively short space (5) and one relatively long space (6) which are provided around the axis of the hub circularly. The housings (7) of the first hub part (2.1) extend axially from the surfaces (13) where the first hub part (2.1) and the second hub part (2.2) are connected, and the housings (7) being located around the first hub part (2.1). The relatively short space (5) and the relatively long space (6) forming each housing (7) extend collaterally.

The second hub part (2.2) comprises a plurality of protrusions (10) each having a relatively short extension (8) and a relatively long extension (9), which are provided circularly around the axis of the hub. The protrusions (10) of the second hub part (2.2) extend axially from the surfaces (14) where the second hub part (2.2) is combined with the first hub part (2.1), and the protrusions (10) being located around the axis of the second hub part (2.2). The relatively short extension (8) and the relatively long extension (9) forming each protrusion (10) extend collaterally. The contour of the inner surface of the housings (7) is in a perfect conformity with the contour of the outer surface of the protrusions (10); and when the hub parts (2.2, 2.1) are mounted to one another, the protrusions (10) are thoroughly fitted into the housings (7).

As the blades (4) are connected to the hub (2) beginning from one end thereof to the other end through the hub (2) thickness, it is not possible for the first hub part (2.1) to be mounted to the second hub part (2.2) by only moving axially the first hub part (2.1); as otherwise the blades (4) of the first hub part (2.1) and the second hub part (2.2) will clash. Therefore, the hub parts (2.1, 2.2) are sometimes moved axially and sometimes rotated towards each other while they are being combined. In order to assure that, the spaces (5,6) of each housing (7) are formed as short and long, and the extensions (8,9) to be fitted into the spaces (5,6) are also formed as short and long.

In order to combine the hub parts (2.1, 2.2), a relatively long extension (9) of the second hub part (2.2) is aligned to a relatively short space (5) of the first hub part (2.1) in the axial direction; and then the second hub part (2.2) is moved towards the first hub part (2.1) in the axial direction, and therefore the relatively long extension (9) of the second hub part (2.2) tries to fit into the relatively short space (5) on the first hub part (2.1). The other long extensions (9) of the second hub part (2.2) start to fit into the other short spaces (5) on the first hub part (2.1), because the protrusions (10) on the second hub part (2.2) and the housings (7) on the first hub part (2.1) have angularly synchronized positions about the rotational axis of the hub; and the number of protrusions (10) and housings (7) are the same. According to a preferred embodiment of the present invention, the number of dents (10) is same with the number of blades on the second hub part (2.2), and likewise the number of housings (7) is same with the number of blades on the first hub part (2.1).

Depending on the blade angle and external geometry of the blades (4), while the second hub part (2.2) is being moved towards the first hub part (2.1) in the axial direction, sometimes it needs to be rotated, otherwise the blades (4) of the second hub part (2.2) clash with the blades (4) of the first hub part (2.1). This rotational movement is performed towards the direction where the long extension (9) of the second hub part (2.2) is located into the relevant long space (6) on the first hub part (2.1). Therefore, in this case, the relatively short extension (8) of the second hub part (2.2) rotates towards the direction where the relevant short space (5) on the first hub part (2.1) is located and therefore a sufficient axial gap is provided between the blades (4), and then the second hub part (2.2) is again moved towards the first hub part (2.1) in the axial direction. These axial and rotational movements are continued until the relatively long extension (9) of the second hub part (2.2) is fitted into the corresponding long space (6) on the first hub part (2.1) and the relatively short extension (8) of the second hub part (2.2) is fitted properly into the corresponding relatively short space (5) on the first hub part (2.1).

The relatively short extension (8) and the relatively long extension (9) together define a step-like form, and likewise the relatively short space (5) and the relatively long space (6) together define a step-like form which provides an advantageous structure for the hub parts (2.1, 2.2) to be combined with each other more rigidly. Because the step-like form defines the connection surfaces (13, 14) of the hub parts (2.1, 2.2) which are orthogonal to the hub rotational axis, and holes (12) for connecting members are formed which extend through the hub (2) running from the connection surfaces (13, 14) of each hub part (2.1, 2.2). In other words, the holes (12) are formed through both the first hub part (2.1) and the second hub part (2.2); and when the first hub part (2.1) is combined with the second hub part (2.2), this is aligned with the holes (12). A connecting member (11) such as a bold is located into each hole (12).

This connecting member (11) may be a stud bolt, the body of which is cylindrical flat, with a screwed-end and having a nut; and the mechanical rigidity of this bolt connection is provided by means of a corresponding nut (19). When the connecting member (11) operates (for example when the bolt is tightened), a rigid connection is provided between the first hub part (2.1) and the second hub part (2.2) with the high friction force generated on the connection surfaces (13,14) of the hub parts (2.1, 2.2). On the other hand, the step-like form defines power transmission surfaces (18) around the hub (2)

axis, which extend through this axis and which are in contact with each other. In addition to the above-mentioned friction force, by means of the power transmission surfaces (18) which are in contact with each other, the power transmission between the first hub part (2.1) and the second hub part (2.2) is contributed.

After the connecting members (11) are fitted, a conical hub case (16) is attached to the front part of the propeller (1) facing the water, in a way that it will cover the diameter of the hub; and this case (16) is fitted to the hub (2) by means of bolts (20).

This completes the description of the preferred and alternate embodiments of the invention. Those skilled in the art may recognize other equivalents to the specific embodiment described herein which equivalents are intended to be encompassed by the claims attached hereto.

What is claimed is:

1. A propeller (1) comprising a cylindrical hub (2) rotatable about an axis; and a plurality of blades (4) provided radially around the hub (2), wherein the hub (2) is made up of a first part (2.1) and a second part (2.2) mounted to the first part (2.1) in the axial direction, wherein the first part (2.1) comprises a plurality of housings (7) each having a relatively short space (5) and a relatively long space (6), the housings (7) provided circularly around the rotation axis; the second part (2.2) comprises a plurality of protrusions (10) each having a relatively short extension (8) and a relatively long extension (9), the protrusions (10) provided circularly around the rotation axis, and wherein the first part (2.1) is rigidly mounted to the second part (2.2) by a plurality of connecting members (11).

2. The propeller according to claim 1, wherein the housings (7) of the first part (2.1) extend from a surface (13, 14) where the first hub part (2.1) is mounted to the second hub part (2.2) in a way that they are located around the axis of the first hub part (2.1) in an axial manner.

3. The propeller according to claim 1, wherein the protrusions (10) of the second part (2.2) extend from a surface (13, 14) where the second part (2.2) is mounted to the first part (2.1) in a way that are located around the axis of the second hub part (2.2) in an axial manner.

4. The propeller according to claim 1, wherein the relatively short space (5) and the relatively long space (6) forming each housing (7) are collaterally formed, and the relatively short extension (8) and the relatively long extension (9) forming each protrusion (10) are collaterally formed.

5. The propeller according to claim 1, wherein each housing (7) has an inner surface contour and each protrusion (10) has an outer surface contour, the inner surface contour and the outer surface contour being formed to be properly fitted one another when the hub parts (2.1, 2.2) are mounted to one another.

6. The propeller according to claim 1, wherein the protrusions (10) on the second part (2.2) and the housings (7) on the first part (2.1) have angularly synchronized positions about the rotational axis of the hub.

7. The propeller according to claim 1, wherein the number of protrusions (10) is same with that of the blades on the second part (2.2), and the number of housings (7) is same with that of the blades on the first part (2.1).

8. The propeller according to claim 1, wherein the relatively short extension (8) and the relatively long extension (9) together define a step-like form, and the relatively short space (5) and the relatively long space (6) together define a step-like form.

9. The propeller according to claim 8, wherein the step-like form comprises connection surfaces (13, 14) being orthogonal to the hub rotational axis, and power transfer surfaces (18) extending around and through the hub axis which are in contact with each other.

10. The propeller according to claim 1, wherein the blades (4) of the respective hub part (2.1,2.2) are integral (one-piece) with this corresponding hub part.

* * * * *